US012303967B2

(12) United States Patent
Lian et al.

(10) Patent No.: US 12,303,967 B2
(45) Date of Patent: May 20, 2025

(54) SET OF NOSEPIECES FOR A RIVET SETTING TOOL

(71) Applicant: MILWAUKEE ELECTRIC TOOL CORPORATION, Brookfield, WI (US)

(72) Inventors: Yi Feng Lian, Bai Tang Town (CN); Jie Liang, Chu Jiang Town (CN)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 989 days.

(21) Appl. No.: 16/267,802

(22) Filed: Feb. 5, 2019

(65) Prior Publication Data

US 2019/0247913 A1 Aug. 15, 2019

(30) Foreign Application Priority Data

Feb. 13, 2018 (CN) ..... 201820256383.2

(51) Int. Cl.

| | |
|---|---|
| ***B21J 15/10*** | (2006.01) |
| *B21J 15/04* | (2006.01) |
| *B21J 15/32* | (2006.01) |

(52) U.S. Cl.

CPC ..... *B21J 15/105* (2013.01); *B21J 15/045* (2013.01); *B21J 15/326* (2013.01)

(58) Field of Classification Search

CPC . B21J 15/10; B21J 15/105; B21J 15/32; B21J 15/34; B21J 15/36

See application file for complete search history.

(56) References Cited

U.S. PATENT DOCUMENTS

| | | | |
|---|---|---|---|
| 2,317,224 | A | 4/1943 | Rylander |
| 2,365,537 | A | 12/1944 | Fischer |
| 2,525,626 | A | 10/1950 | Stouffer et al. |
| 2,714,250 | A | 8/1955 | Twedt |
| 2,845,197 | A | 7/1958 | Newstead |
| 3,828,603 | A | 8/1974 | Sheffield et al. |
| 3,892,120 | A | 7/1975 | Sheffield et al. |
| 4,044,591 | A | 8/1977 | Powderley |
| 4,263,801 | A | 4/1981 | Gregory |
| 4,368,838 | A | 1/1983 | Sheffield et al. |
| 4,375,760 | A | 3/1983 | Savage et al. |
| 4,552,010 | A | 11/1985 | Hein |

(Continued)

FOREIGN PATENT DOCUMENTS

| | | | |
|---|---|---|---|
| CN | 2881850 | Y * | 3/2007 |
| CN | 100393447 | C | 6/2008 |

(Continued)

OTHER PUBLICATIONS

FSI, D-9000-MIL-2, 2009 (Year: 2009).*

(Continued)

*Primary Examiner* — Matthew Katcoff

(74) *Attorney, Agent, or Firm* — Michael Best & Friedrich LLP

(57) ABSTRACT

A set of nosepieces are configured to attach to a rivet setting tool. The set of nosepieces comprises a first nosepiece with a longitudinal bore having a first diameter and an O-ring having a first color, and a second nosepiece with a longitudinal bore having a second diameter that is different than the first diameter and an O-ring having a second color that is different than the first color.

18 Claims, 6 Drawing Sheets

(56) References Cited

U.S. PATENT DOCUMENTS

| | | | | |
|---|---|---|---|---|
| 4,691,552 | A | 9/1987 | Peterson | |
| 4,896,522 | A | 1/1990 | Rosier | |
| 5,036,572 | A | 8/1991 | Rosier | |
| 5,143,216 | A | 9/1992 | Aurtoi et al. | |
| 5,146,773 | A | 9/1992 | Rosier | |
| 5,323,946 | A | 6/1994 | O'Conner et al. | |
| 5,473,805 | A | 12/1995 | Wille | |
| 5,605,070 | A | 2/1997 | Wille | |
| 5,779,127 | A | 7/1998 | Blacket et al. | |
| 5,960,667 | A | 10/1999 | Hylwa et al. | |
| 6,000,596 | A | 12/1999 | Cariati | |
| 6,018,978 | A | 2/2000 | Aniento | |
| 6,026,551 | A | 2/2000 | Honsel et al. | |
| 6,141,849 | A | 11/2000 | Honsel et al. | |
| 6,145,360 | A | 11/2000 | Honsel et al. | |
| 6,163,945 | A | 12/2000 | Amano et al. | |
| 6,182,345 | B1 | 2/2001 | Travis | |
| 6,212,931 | B1 | 4/2001 | Solfronk | |
| 6,272,899 | B1 | 8/2001 | Bentivogli | |
| 6,276,037 | B1 | 8/2001 | Solfronk | |
| 6,301,948 | B1 | 10/2001 | Weiland | |
| 6,367,139 | B2 | 4/2002 | Wille | |
| 6,425,170 | B1 | 7/2002 | Zirps et al. | |
| 6,622,363 | B2 | 9/2003 | Komsta | |
| 6,629,360 | B2 | 10/2003 | Ohuchi | |
| 6,637,099 | B1 | 10/2003 | Seewraj | |
| 6,684,470 | B1 | 2/2004 | Joux | |
| 6,704,986 | B1 | 3/2004 | Liu | |
| 6,883,216 | B2 | 4/2005 | Gilbert et al. | |
| 6,886,226 | B1 | 5/2005 | Dear et al. | |
| 6,904,831 | B2 | 6/2005 | Aasgaard | |
| 6,907,648 | B2 | 6/2005 | Eldessouky | |
| 6,907,649 | B2 | 6/2005 | Yamada | |
| 6,918,279 | B2 | 7/2005 | Wille | |
| 6,925,695 | B2 | 8/2005 | Woyciesjes et al. | |
| 7,040,010 | B2 | 5/2006 | Bouman | |
| 7,043,807 | B2 | 5/2006 | Woyciesjes et al. | |
| 7,082,657 | B1 | 8/2006 | Lin | |
| 7,140,227 | B2 | 11/2006 | Bouman et al. | |
| 7,159,291 | B2 | 1/2007 | Ohuchi | |
| 7,263,753 | B2 | 9/2007 | El Dessouky | |
| 7,322,783 | B2 | 1/2008 | Pearce et al. | |
| 7,331,205 | B2 | 2/2008 | Chitty et al. | |
| 7,346,971 | B2 | 3/2008 | Chitty | |
| 7,347,078 | B1 | 3/2008 | Hopkins et al. | |
| 7,366,816 | B2 | 4/2008 | Rai | |
| 7,464,454 | B2 | 12/2008 | Aasgaard | |
| 7,503,196 | B2 | 3/2009 | Chitty et al. | |
| 7,559,133 | B2 | 7/2009 | Chitty et al. | |
| 7,681,429 | B1 | 3/2010 | Huang et al. | |
| 7,698,794 | B2 | 4/2010 | Cobzaru | |
| 7,712,209 | B2 | 5/2010 | Bouman et al. | |
| 7,818,859 | B2 | 10/2010 | Pearce et al. | |
| 7,930,810 | B2 | 4/2011 | Mitomi | |
| 8,006,361 | B2 | 8/2011 | Hutter, III et al. | |
| 8,015,699 | B2 | 9/2011 | Fulbright | |
| 8,091,195 | B2 | 1/2012 | Lin | |
| 8,099,846 | B2 | 1/2012 | King et al. | |
| 8,109,123 | B2 | 2/2012 | Chen | |
| 8,151,423 | B2 | 4/2012 | Dear et al. | |
| 8,161,622 | B2 | 4/2012 | King et al. | |
| 8,256,104 | B2 | 9/2012 | Fulbright | |
| 8,312,756 | B2 | 11/2012 | Swinford | |
| 8,365,375 | B2 | 2/2013 | Lin | |
| 8,443,512 | B2 | 5/2013 | Masugata | |
| 8,449,234 | B2 | 5/2013 | Taylor | |
| 8,474,119 | B2 | 7/2013 | Lv et al. | |
| 8,615,860 | B2 | 12/2013 | Cobzaru et al. | |
| 8,677,587 | B2 | 3/2014 | Liu | |
| 8,677,588 | B2 | 3/2014 | Soller | |
| 8,689,419 | B2 | 4/2014 | Lin | |
| 8,707,530 | B2 | 4/2014 | Lin | |
| 8,776,338 | B2 * | 7/2014 | Yuan | B21J 15/386 29/243.521 |
| 8,893,363 | B2 | 11/2014 | Taylor | |
| 8,904,612 | B1 | 12/2014 | Lin | |
| 8,925,166 | B2 | 1/2015 | Erni | |
| 8,935,948 | B1 | 1/2015 | Gregory | |
| 9,079,240 | B2 | 7/2015 | Schiffler et al. | |
| 9,180,510 | B2 | 11/2015 | Sugata et al. | |
| 9,289,818 | B2 | 3/2016 | Skolaude | |
| 9,968,988 | B2 * | 5/2018 | Masugata | B21J 15/043 |
| 10,532,396 | B2 * | 1/2020 | Olsson | B21J 15/26 |
| 2006/0150402 | A1 | 7/2006 | Lin | |
| 2006/0180629 | A1 | 8/2006 | Lin | |
| 2008/0012453 | A1 | 1/2008 | Aasgaard | |
| 2009/0031545 | A1 | 2/2009 | Keppel | |
| 2009/0205184 | A1 | 8/2009 | Seewraj et al. | |
| 2010/0071182 | A1 | 3/2010 | Ho et al. | |
| 2010/0139066 | A1 | 6/2010 | Chen | |
| 2010/0275424 | A1 | 11/2010 | Masugata | |
| 2010/0295696 | A1 | 11/2010 | Chu et al. | |
| 2011/0271504 | A1 | 11/2011 | Preti | |
| 2011/0289745 | A1 | 12/2011 | Ho et al. | |
| 2012/0104304 | A1 | 5/2012 | Lin | |
| 2012/0240371 | A1 * | 9/2012 | Mori | B21J 15/105 29/243.521 |
| 2013/0117981 | A1 | 5/2013 | Seewraj et al. | |
| 2013/0205577 | A1 | 8/2013 | Soller | |
| 2013/0312245 | A1 | 11/2013 | Skolaude et al. | |
| 2014/0250649 | A1 | 9/2014 | Masugata | |
| 2015/0040373 | A1 | 2/2015 | Chen | |
| 2015/0074964 | A1 | 3/2015 | Masugata | |
| 2015/0196951 | A1 | 7/2015 | Bigot et al. | |
| 2015/0336159 | A1 | 11/2015 | Gaertner et al. | |
| 2015/0360355 | A1 | 12/2015 | Hsu et al. | |
| 2016/0045950 | A1 | 2/2016 | Gaertner et al. | |
| 2016/0107224 | A1 | 4/2016 | King | |

FOREIGN PATENT DOCUMENTS

| | | | |
|---|---|---|---|
| CN | 102000760 | A | 4/2011 |
| CN | 101579717 | B | 5/2011 |
| CN | 102225453 | A | 10/2011 |
| CN | 202087763 | U | 12/2011 |
| CN | 203091652 | U | 7/2013 |
| CN | 204247901 | U | 4/2015 |
| CN | 105414439 | A | 3/2016 |
| DE | 3923263 | A1 | 1/1991 |
| DE | 29914202 | U1 | 12/2000 |
| DE | 20104373 | U1 | 6/2001 |
| DE | 10115728 | A1 | 10/2001 |
| DE | 202004004148 | U1 | 7/2004 |
| DE | 202004012268 | U1 | 12/2005 |
| DE | 202004012269 | U1 | 12/2005 |
| DE | 202006014607 | U1 | 11/2006 |
| DE | 202009001230 | U1 | 4/2009 |
| DE | 102008013044 | B3 | 7/2009 |
| DE | 202010007250 | U1 | 10/2010 |
| DE | 202012101490 | U1 | 5/2012 |
| DE | 10316578 | B4 | 6/2012 |
| DE | 202012101492 | U1 | 8/2012 |
| DE | 102012019177 | A1 | 3/2014 |
| DE | 102013219217 | A1 | 3/2015 |
| DE | 102013221789 | A1 | 4/2015 |
| DE | 102013221790 | A1 | 5/2015 |
| DE | 102013221792 | A1 | 5/2015 |
| DE | 102014208841 | A1 | 11/2015 |
| DE | 202012013277 | U1 | 11/2015 |
| DE | 102014223303 | A1 | 5/2016 |
| EP | 0065110 | B1 | 11/1982 |
| EP | 0927586 | A2 | 7/1999 |
| EP | 0787563 | B1 | 4/2002 |
| EP | 1297916 | A2 | 4/2003 |
| EP | 0928649 | B1 | 6/2003 |
| EP | 1402974 | A2 | 3/2004 |
| EP | 1166918 | B1 | 1/2005 |
| EP | 1300205 | B1 | 4/2005 |
| EP | 1525928 | A2 | 4/2005 |
| EP | 0927585 | B1 | 4/2006 |
| EP | 1232812 | B1 | 1/2007 |
| EP | 1525928 | B1 | 5/2007 |
| EP | 2113317 | A1 | 11/2009 |
| EP | 2176034 | B1 | 4/2010 |

(56) References Cited

FOREIGN PATENT DOCUMENTS

| | | | |
|---|---|---|---|
| EP | 2305396 | A2 | 4/2011 |
| EP | 1738845 | B1 | 1/2013 |
| EP | 2564949 | A2 | 3/2013 |
| EP | 2823911 | A2 | 1/2015 |
| EP | 2626154 | B1 | 12/2015 |
| EP | 2565469 | B1 | 3/2016 |
| FR | 2990634 | B1 | 2/2015 |
| FR | 3013999 | B1 | 1/2016 |
| GB | 800427 | A | 8/1958 |
| GB | 1397543 | A | 6/1975 |
| WO | WO 9625258 | A1 | 8/1996 |
| WO | WO 03078090 | A1 | 9/2003 |
| WO | WO 2005025772 | A1 | 3/2005 |
| WO | WO 2008099132 | A1 | 8/2008 |
| WO | WO 2008119849 | A1 | 10/2008 |
| WO | WO 2009072836 | A2 | 6/2009 |
| WO | WO 2011060499 | A1 | 5/2011 |
| WO | WO 2012120132 | A1 | 9/2012 |
| WO | WO 2015049738 | A1 | 4/2015 |

OTHER PUBLICATIONS

Gesipa, Blind Rivet Tools: Portable Electric Installation Tools. <http://www.gesipausa.com/portable_installation_tools.htm> website available as early as Sep. 2006, 2 pages.

* cited by examiner

SET OF NOSEPIECES FOR A RIVET SETTING TOOL

FIELD OF THE INVENTION

The present invention relates to rivet setting tools, and more particularly to nosepieces for riveting tools.

BACKGROUND OF THE INVENTION

Rivet setting tools may use interchangeable nosepieces for adapting the rivet setting tool for use with different sized rivets.

SUMMARY OF THE INVENTION

The present invention provides, in one aspect, a set of nosepieces configured to attach to a rivet setting tool. The set of nosepieces comprise a first nosepiece with a longitudinal bore having a first diameter and an O-ring having a first color, and a second nosepiece with a longitudinal bore having a second diameter that is different than the first diameter and an O-ring having a second color that is different than the first color.

The present invention provides, in another aspect, a rivet tool set comprising a rivet tool including a housing, a pulling mechanism within the housing, and a plurality of jaws between which a mandrel of a rivet is receivable, the jaws arranged within a setting end of the housing. The rivet tool set further comprises a set of nosepieces, each nosepiece in the set removably attachable to the setting end of the housing. The set of nosepieces comprise a first nosepiece with a longitudinal bore having a first diameter and an O-ring having a first color and a second nosepiece with a longitudinal bore having a second diameter that is different than the first diameter and an O-ring having a second color that is different than the first color.

The present invention provides, in yet another aspect, a set of nosepieces, each nosepiece in the set configured to attach to a rivet setting tool, each nosepiece in the set configured to receive a mandrel of a rivet. The set of nosepieces comprises a first nosepiece with a longitudinal bore having a first diameter and an O-ring having a first color, a second nosepiece with a longitudinal bore having a second diameter and an O-ring having a second color, a third nosepiece with a longitudinal bore having a third diameter and an O-ring having a third color, and a fourth nosepiece with a longitudinal bore having a fourth diameter and an O-ring having a fourth color. The first, second, third and fourth diameters are different from one another and the first, second, third and fourth colors are different from one another. The first color indicates that the first diameter corresponds to mandrels of a first rivet size, the second color indicates that the second diameter corresponds to mandrels of a second rivet size, the third color indicates that the third diameter corresponds to mandrels of a third rivet size, and the fourth color indicates that the fourth diameter corresponds to mandrels of a fourth rivet size.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
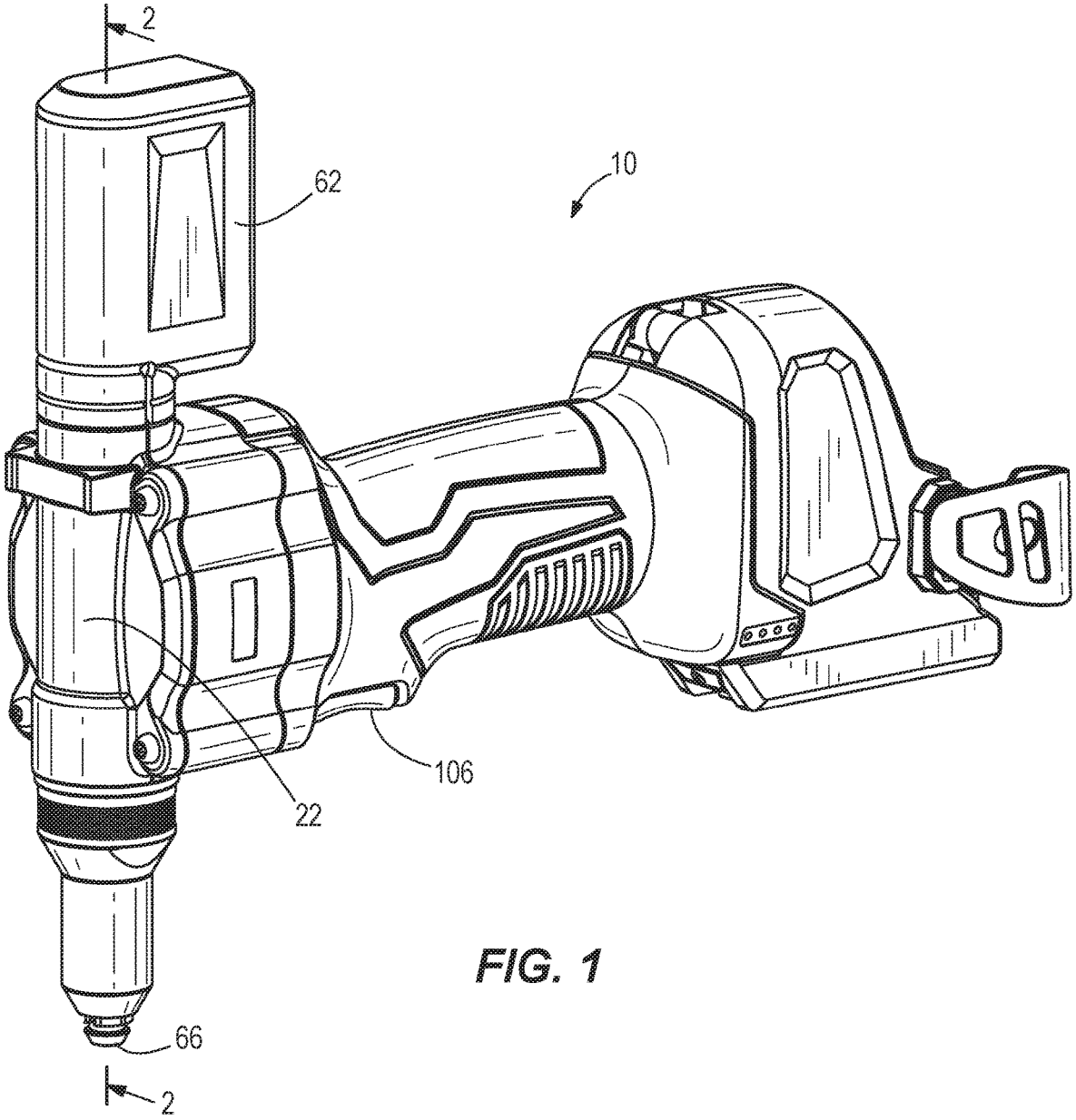
FIG. 1 is a perspective view of a rivet setting tool.
Figure 2:
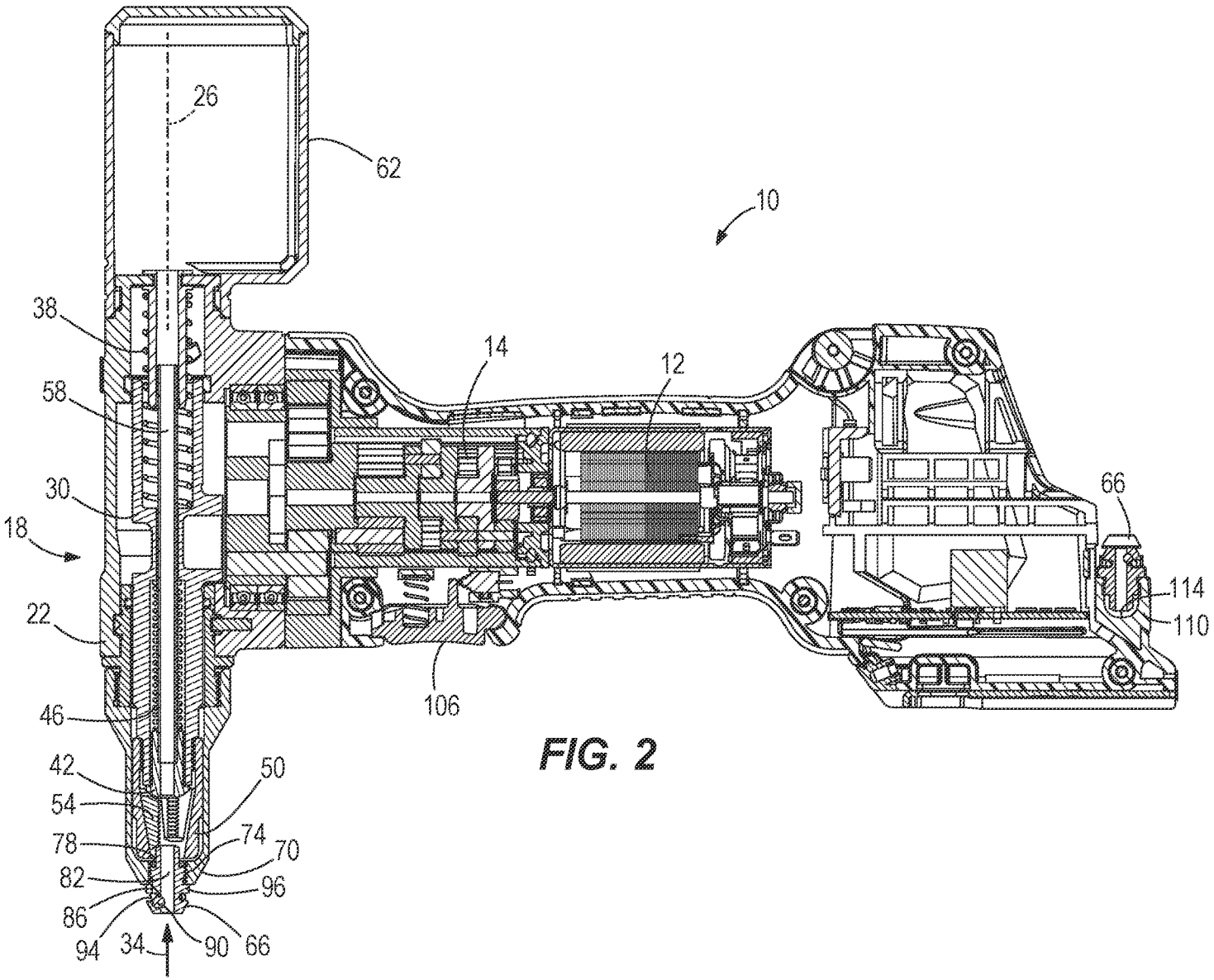
FIG. 2 is a cross-sectional view of the rivet setting tool of FIG. 1.

With reference to FIGS. 1 and 2, a rivet setting tool 10, such as a blind rivet setting tool, includes an electric motor 12 and a transmission 14 (e.g., a multi-stage planetary transmission) that receives torque from the motor 12. The tool 10 also includes a pulling mechanism 18 that is actuated in response to activation of the motor 12 to initiate a rivet setting process. The rivet setting tool 10 may include an on-board power source (e.g., a battery, not shown) or an electrical cord (also not shown) for connection to a remote power source (e.g., an alternating current source).

With reference to FIG. 2, the tool 10 includes a housing 22 in which the pulling mechanism 18 is positioned and arranged along a longitudinal axis 26 along which a mandrel of a rivet is pulled. The pulling mechanism 18 includes a pulling head 30 biased opposite a pulling direction 34 of the mandrel by a head spring 38. The pulling mechanism 18 further includes a jaw pusher 42 within the pulling head 30 and biased opposite the pulling direction 34 by a pusher spring 46 set within the pulling head 30. A jaw sleeve 50 is coupled to the pulling head 30 for movement therewith in the pulling direction 34.

The pulling mechanism 18 also includes a first plurality of jaws 54 set at least partially within the jaw sleeve 50 and pushed opposite the pulling direction 34 by the jaw spring 46 and jaw pusher 42. A spent-mandrel tube 58 extends along the longitudinal axis 26 through the jaw pusher 42, the pusher spring 46, the pulling head 30, and the head spring 38, terminating in a mandrel container 62 to collect broken mandrels after a rivet-setting operation has been completed. A nosepiece 66 is provided at a setting end 70 of the housing 22 opposite the mandrel container 62.

Figure 3:
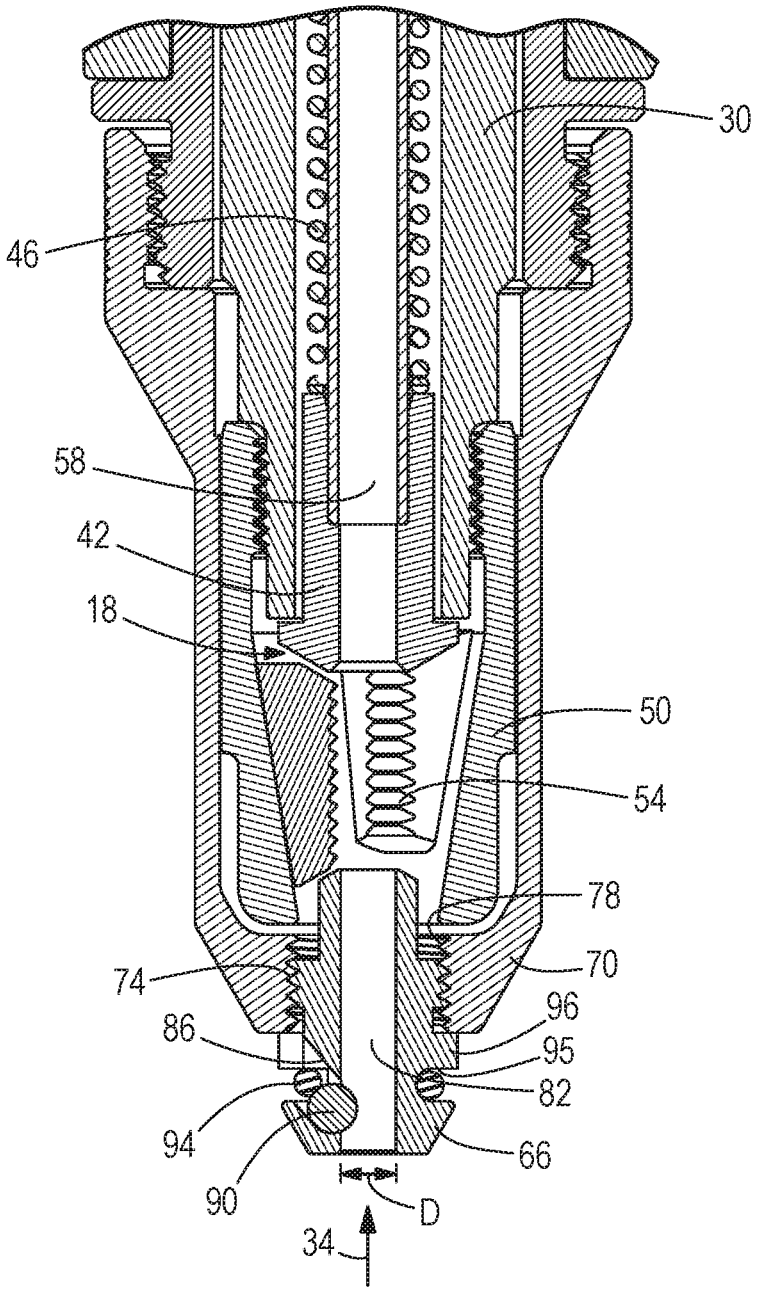
FIG. 3 is an enlarged view of a portion of a pulling mechanism of the rivet setting tool of FIG. 1.

With reference to FIG. 3, the nosepiece 66 has male threads 74 that engage female threads 78 in the setting end 70 of the housing. In other embodiments, the threads of the nosepiece 66 may be female and the setting end 70 may include mating male threads. The nosepiece 66 includes a longitudinal bore 82 that is coaxial with the spent-mandrel tube 58 and permits an operator to insert a mandrel of the rivet through the nosepiece 66 and between the jaws 54 in a position where the mandrel can be clamped. As shown in FIG. 3, the longitudinal bore 82 has a diameter D. The nosepiece also includes a radial bore 86 in communication with the longitudinal bore 82. A ball detent 90 is arranged in the radial bore 86. The ball detent 90 is biased inwardly toward the axis 26 by an O-ring 94 arranged in a circumferential groove 95 surrounding the nosepiece 66 and adjacent a hexagonal ledge 96 that permits an operator to use a wrench to attach the nosepiece 66 to the setting end 70. In a biased position, the ball detent 90 projects into the longitudinal bore 82 of the nosepiece 66.

Figure 4:
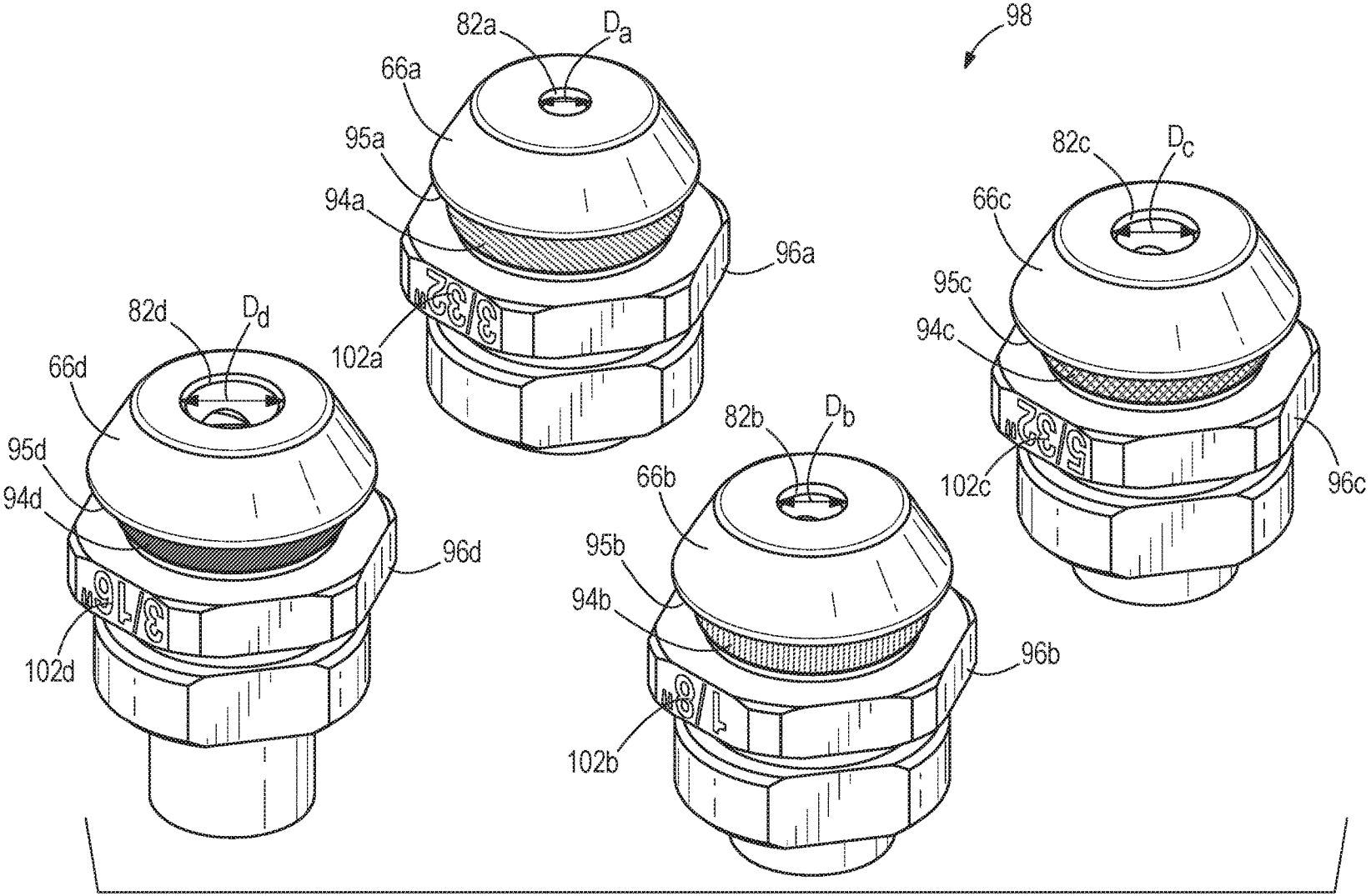
FIG. 4 is a perspective view of a set of nosepieces for use with the rivet setting tool of FIG. 1.
Figure 5:
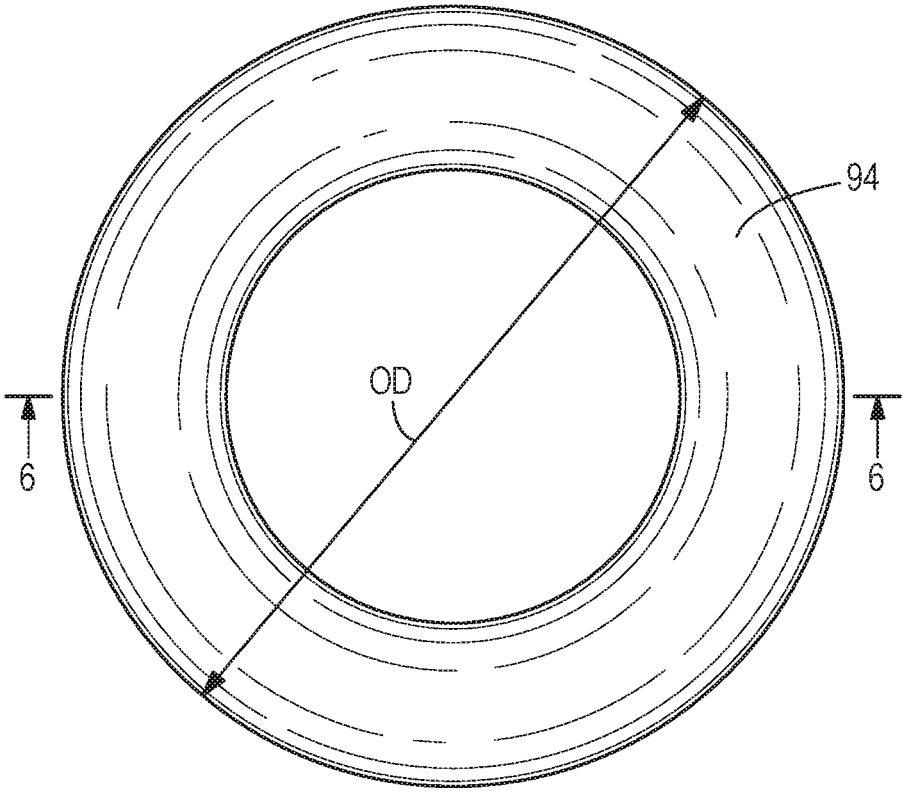
FIG. 5 is a plan view of an O-ring of one of the nosepieces of FIG. 4.
Figure 6:
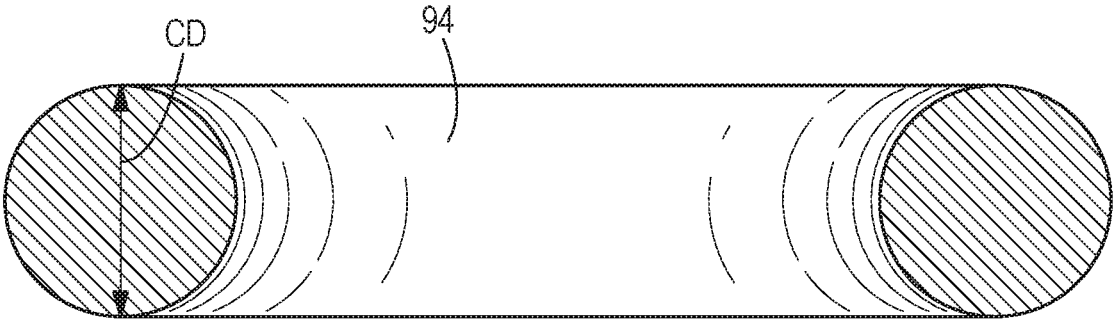
FIG. 6 is a cross-sectional view of an O-ring of one of the nosepieces of FIG. 4.

As shown in FIG. 4, the nosepiece 66 is one nosepiece of a set of nosepieces 98. Each nosepiece 66 and its respective components (as described above) is labeled herein, and in FIGS. 4 and 7, using the reference characters described above followed by the letter "a", "b", "c", or "d" respectively. Each of the nosepieces 66*a*, 66*b*, 66*c*, and 66*d* in the set 98 has indicia 102*a*, 102*b*, 102*c*, 102*d*, such as units of measurements 3/32", 1/8", 5/32", and 3/16", that indicate measurements of diameters Da, Db, Dc, and Dd of longitudinal bore 82*a*, 82*b*, 82*c*, and 82*d* to the operator. The diameters Da, Db, Dc, and Dd correspond to the diameters of mandrels of different sized rivets that can be set by the rivet setting tool 10. Each of the nosepieces 66*a*, 66*b*, 66*c*, and 66*d* also include a different colored O-ring 94*a*, 94*b*, 94*c*, and 94*d*. The different colors of the O-rings 94*a*, 94*b*, 94*c*, and 94*d* also provide a quick means of informing the operator as to what size mandrel the nosepieces 66*a*, 66*b*, 66*c*, and 66*d* are appropriate. As shown in FIGS. 5 and 6, each O-ring 94 has an outer diameter OD and a cross-sectional diameter CD. The below table illustrates some typical sizes associated with the nosepieces 66*a*, 66*b*, 66*c*, 66*d*, their respective O-rings 94*a*, 94*b*, 94*c*, 94*d* and the diameters Da, Db, Dc, and Dd that correspond to mandrel sizes that they are configured to receive. However, other colors and dimensions D, OD, and CD for longitudinal bore 82 and O-ring 94 may be used.

| Nosepiece 66 | O-ring 94 | D of longitudinal bore 82 | Color of O-ring 94 | OD of O-ring 94 | CD of O-ring 94 |
|---|---|---|---|---|---|
| 66a | 94a | Da = 3/32" = .09375" (2.38125 mm) | Green | ODa = .1397638" (3.55 mm) | CDa = .0708661" (1.8 mm) |
| 66b | 94b | Db = 1/8" = .125" (3.175 mm) | Red | ODb = .15748" (4 mm) | CDb = .0708661" (1.8 mm) |
| 66c | 94c | Dc = 5/32" = .15625" (3.96875 mm) | Brown | ODc = .1759843" (4.47 mm) | CDc = .07007874" (1.78 mm) |
| 66d | 94d | Dd = 3/16" = .1875" (4.7625 mm) | Black | ODd = .19685" (5 mm) | CDd = .0708661" (1.8 mm) |

Figure 7:
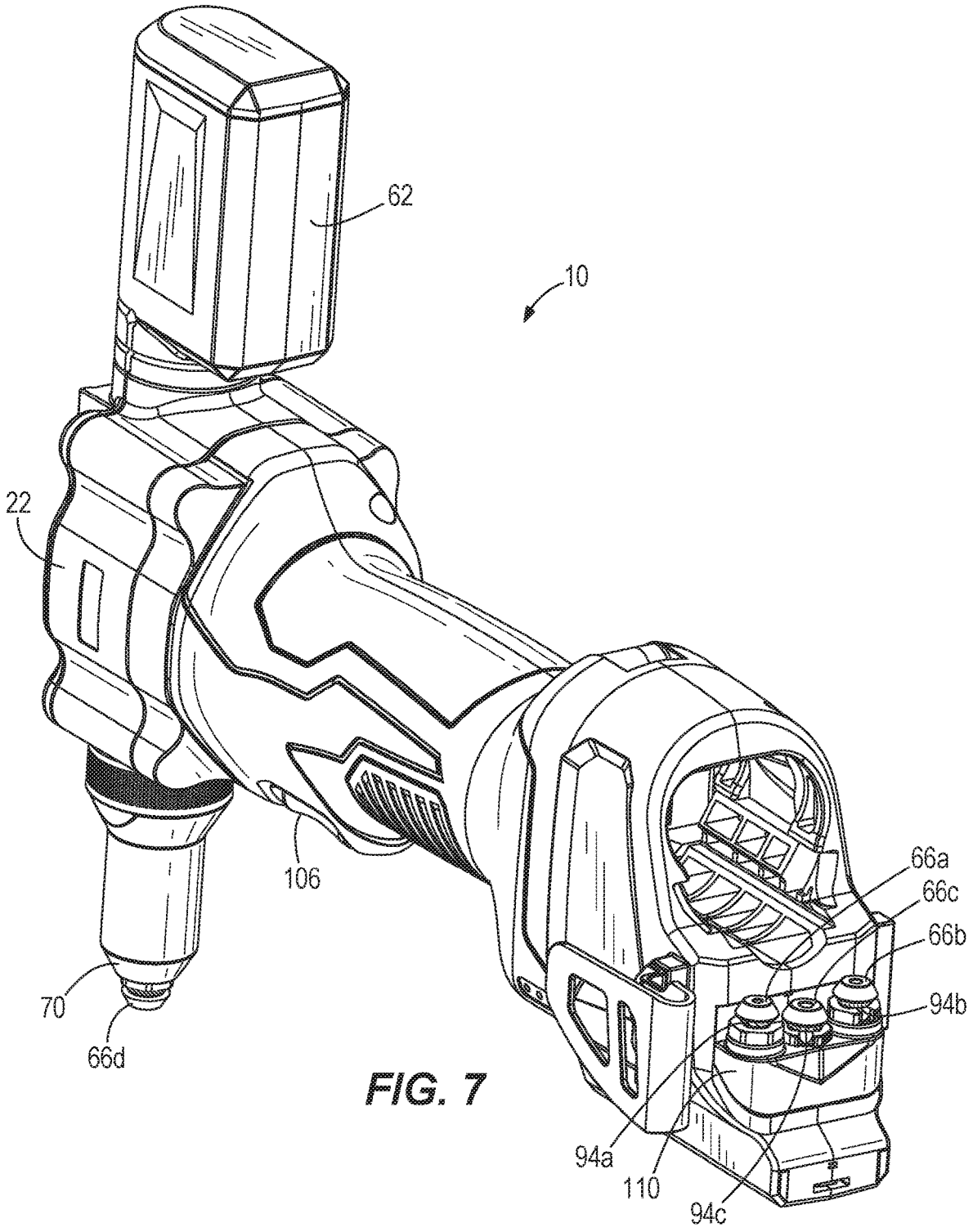
FIG. 7 is another perspective view of the rivet setting tool of FIG. 1.

As shown in FIG. 7, when one of the nosepieces in set 98, for example nosepiece 66*d*, is attached to the setting end 70, the unused nosepieces 66*a*, 66*b*, 66*c* may be stored in an on-board storage receptacle 110 defining recesses 114 (FIG. 2) to receive the unused nosepieces 66*a*, 66*b*, 66*c*. The nosepieces 66*a*, 66*b*, 66*c* are stored in the storage receptacle 110 in such a way that their respective O-rings 94*a*, 94*b*, 94*c* are exposed above the recesses 114, making them easy for an operator to quickly to identify.

In operation, an operator first determines what size rivet is required to be set. The operator may then glance over the set of nosepieces 98 and quickly determine which nosepiece 66*a*, 66*b*, 66*c*, 66*d* to use based on the different colored O-rings 94*a*, 94*b*, 94*c*, 94*d*. For instance, the operator may know the rivet to be set is a 5/32" rivet, and quickly grab the correct nosepiece 66*c* by identifying the brown O-ring 94*c*. Alternatively, the operator may glance at the set of nosepieces 98 and quickly determine which nosepiece 66*a*, 66*b*, 66*c*, 66*d* to use based on the different indicia 102*a*, 102*b*, 102*c*, 102*d*.

The operator then attaches the appropriate nosepiece 66 to the setting end 70 by threading the male threads 74 of the nosepiece 66 onto the female threads 78 in the setting end 70. The operator then inserts the appropriately sized mandrel through the longitudinal bore 82 of the nosepiece 66 and between the jaws 54. The size of the mandrel corresponds to the diameter D of the appropriate nosepiece 66. As the mandrel of the rivet is inserted into the longitudinal bore 82, it moves the ball detent 90 radially outward and into the radial bore 86. Prior to beginning the rivet setting operation, the ball detent 90 exerts a clamping force against the mandrel to retain it in the nose piece 66.

The operator then activates the motor 12 by pulling a trigger 106 on the tool 10, which causes the transmission 14 to retract the pulling head 30, moving it against the biasing force of the head spring 38 along the longitudinal axis 26 and away from the nosepiece 66. The jaw sleeve 50 is also drawn in the pulling direction 34 in unison with the pulling head 30, displacing the jaws 54 toward the axis 26 and causing the jaws 54 to clamp and pull the mandrel of the rivet. As the pulling head 30 and jaw sleeve 50 continue to move in the pulling direction 34, the rivet is eventually set and the mandrel is severed. The broken mandrel is now free to slide through the spent-mandrel tube 58 for collection in the mandrel container 62. After the broken mandrel has slid into the spent-mandrel tube 58, the ball detent 90 returns to the biased position, thereby blocking the broken mandrel from falling out of the longitudinal bore 82 of the nose piece 66.

If the operator needs to subsequently set a rivet of a different size, the operator removes the current nosepiece 66 attached to the setting end 70 and again glances at the set of nosepieces 98 to quickly determine which nosepiece 66*a*, 66*b*, 66*c*, 66*d* to use based on the different colored O-rings 94*a*, 94*b*, 94*c*, 94*d*. For instance, the operator may know the subsequent rivet to be set is a 1/8" rivet, and quickly grabs the correct nosepiece 66*b* by identifying the red O-ring 94*b*. The operator then attaches the new nosepiece 66*b* in the manner described above and sets the 1/8" rivet in the manner described above.

Various features of the invention are set forth in the following claims.

What is claimed is:

1. A set of nosepieces, each nosepiece in the set configured to attach to a rivet setting tool, the set of nosepieces comprising:

a first nosepiece with a first longitudinal bore having a first diameter, a first detent, and a first O-ring configured to bias the first detent, the first O-ring having a first color; and a second nosepiece with a second longitudinal bore having a second diameter that is different than the first diameter, a second detent, and a second O-ring configured to bias the second detent, the second O-ring having a second color that is different than the first color;

wherein the first O-ring has a first cross-sectional diameter and the second O-ring has a second cross-sectional diameter different from the first cross-sectional diameter.

2. The set of nosepieces of claim 1, wherein each of the nosepieces further comprises a hexagonal ledge.

3. The set of nosepieces of claim 1, wherein each of the nosepieces further comprises a circumferential groove in which their respective O-ring is arranged.

4. The set of nosepieces of claim 3, wherein each of the nosepieces further comprises a radial bore in communication with their respective longitudinal bore and their respective circumferential groove, wherein each of their respective detents includes a ball detent arranged in the respective radial bore, and wherein each ball detent is biased radially inward by their respective O-ring.

5. The set of nosepieces of claim 4, wherein in a biased position, each ball detent projects into their respective longitudinal bore.

6. The set of nosepieces of claim 1, wherein each of the nosepieces further comprises an indicia to indicate a size of the diameter of their respective longitudinal bores.

7. The set of nosepieces of claim 1, further comprising:

a third nosepiece with a third longitudinal bore having a third diameter that is different from the first and second diameters, a third detent, and a third O-ring configured to bias the third detent, the third O-ring having a third color that is different from the first and second colors, and a fourth nosepiece with a fourth longitudinal bore having a fourth diameter that is different from the first, second, and third diameters, a fourth detent, and a fourth O-ring configured to bias the fourth detent, the fourth O-ring having a fourth color that is different from the first, second, and third colors.

8. The set of nosepieces of claim 7, wherein the first diameter is 3/32", the second diameter is 1/8", the third diameter is 5/32", and the fourth diameter is 3/16".

9. A rivet tool set, the rivet tool set comprising:

a rivet tool including a housing, a pulling head within the housing, a handle with a grip portion defining a generally longitudinal direction, and a plurality of jaws between which a mandrel of a rivet is receivable, the jaws arranged within a setting end of the housing; and a set of nosepieces, each nosepiece in the set removably attachable to the setting end of the housing, the set of nosepieces including a first nosepiece with a first longitudinal bore having a first diameter, a first detent, and a first O-ring configured to bias the first detent, the first O-ring having a first color;

a second nosepiece with a second longitudinal bore having a second diameter that is different than the first diameter, a second detent, and a second O-ring configured to bias the second detent, the second O-ring having a second color that is different than the first color; and wherein the rivet tool further includes an on-board storage receptacle defining individual recesses each configured to receive an unused one of the first or second nosepieces, and wherein the grip portion is disposed between the on-board storage receptacle and the pulling head in the generally longitudinal direction.

10. The rivet tool set of claim 9, wherein each of the nosepieces further comprises a circumferential groove in which their respective O-ring is arranged.

11. The rivet tool set of claim 10, wherein each of the nosepieces further comprises a radial bore in communication with their respective longitudinal bore and their respective circumferential groove, and wherein each of their respective detents includes a ball detent arranged in the respective radial bore, and wherein each ball detent is biased radially inward by their respective O-ring.

12. The rivet tool set of claim 11, wherein in a biased position, each ball detent projects into their respective longitudinal bore.

13. The rivet tool set of claim 9, wherein each of the nosepieces further comprises an indicia to indicate a size of the diameter of their respective longitudinal bores.

14. The rivet tool set of claim 9, further comprising:

a third nosepiece with a third longitudinal bore having a third diameter that is different from the first and second diameters, a third detent, and a third O-ring configured to bias the third detent, the third O-ring having a third color that is different from the first and second colors, and a fourth nosepiece with a fourth longitudinal bore having a fourth diameter that is different from the first, second and third diameters, a fourth detent, and a fourth O-ring configured to bias the fourth detent, the fourth O-ring having a fourth color that is different from the first, second and third colors.

15. The rivet tool set of claim 14, wherein the first diameter is 3/32", the second diameter is 1/8", the third diameter is 5/32", and the fourth diameter is 3/16".

16. The rivet tool set of claim 14, wherein the rivet tool further comprises an on-board storage receptacle defining individual recesses each configured to receive an unused one of the first, second, third, or fourth nosepieces such that their respective O-rings are exposed above the respective individual recess for an operator to identify.

17. The set of nosepieces of claim 1, wherein the first O-ring has a first outer diameter and the second O-ring has a second outer diameter different from the first outer diameter.

18. The set of nosepieces of claim 17, wherein the second diameter of the second longitudinal bore is larger than the first diameter of the first longitudinal bore, and wherein second outer diameter of the second O-ring is larger than the first outer diameter of the first O-ring.

* * * * *